US012441573B2

(12) United States Patent
Sudo et al.

(10) Patent No.: US 12,441,573 B2
(45) Date of Patent: Oct. 14, 2025

(54) FLAT WOUND TAPE ARTICLE AND METHOD

(71) Applicant: 3M INNOVATIVE PROPERTIES COMPANY, St. Paul, MN (US)

(72) Inventors: Yasuo Sudo, Tokyo (JP); Keiichiro Horikoshi, Yamagata (JP); Hidekuni Takano, Tokyo (JP)

(73) Assignee: 3M Innovative Properties Company, St. Paul, MN (US)

( * ) Notice: Subject to any disclaimer, the term of this patent is extended or adjusted under 35 U.S.C. 154(b) by 729 days.

(21) Appl. No.: 17/628,316

(22) PCT Filed: Jul. 30, 2020

(86) PCT No.: PCT/IB2020/057204

§ 371 (c)(1),
(2) Date: Jan. 19, 2022

(87) PCT Pub. No.: WO2021/019490

PCT Pub. Date: Feb. 4, 2021

(65) Prior Publication Data

US 2022/0250865 A1 Aug. 11, 2022

Related U.S. Application Data

(60) Provisional application No. 62/881,425, filed on Aug. 1, 2019.

(51) Int. Cl.
*B65H 35/00* (2006.01)
*B65H 75/06* (2006.01)

(52) U.S. Cl.
CPC ..... *B65H 35/0033* (2013.01); *B65H 75/06* (2013.01); *B65H 2301/4127* (2013.01); *B65H 2701/535* (2013.01)

(58) Field of Classification Search
None
See application file for complete search history.

(56) References Cited

U.S. PATENT DOCUMENTS

| | | | | |
|---|---|---|---|---|
| 4,353,613 | A * | 10/1982 | Carlow | B65H 75/4473 439/501 |
| 6,142,451 | A * | 11/2000 | Lindsey | B65H 75/06 242/405.1 |
| 6,418,998 | B1 * | 7/2002 | Tuoriniemi | B65H 35/0026 156/577 |
| 7,060,352 | B2 | 6/2006 | Robin | |
| 2011/0086563 | A1 | 4/2011 | Lange et al. | |

(Continued)

FOREIGN PATENT DOCUMENTS

| | | |
|---|---|---|
| DE | 8328594 | 1/1984 |
| GB | 2017047 | 10/1979 |
| JP | S52-047092 | 4/1977 |

(Continued)

OTHER PUBLICATIONS

International Search Report for PCT International Application No. PCT/IB2020/057204, mailed on Oct. 30, 2020, 5 pages.

*Primary Examiner* — William A. Rivera

(57) ABSTRACT

Flat wound tape article with a flat core and tape wound around the core. The article is configured so that it can help protect the edges of the tape from adhering to dirt, dust, lint, etc. while maintaining a convenient shape for use.

20 Claims, 5 Drawing Sheets

(56) References Cited

U.S. PATENT DOCUMENTS

2016/0221788 A1* 8/2016 Foreman ..... B65D 83/0841

FOREIGN PATENT DOCUMENTS

| | | |
|---|---|---|
| JP | H06-183633 | 7/1994 |
| JP | 3032507 | 4/2000 |
| JP | 2004-531601 | 10/2004 |
| JP | 2017-071508 | 4/2017 |
| JP | 2018-178445 | 11/2018 |
| WO | WO2002-055410 | 7/2002 |

* cited by examiner

FLAT WOUND TAPE ARTICLE AND METHOD

CROSS REFERENCE TO RELATED APPLICATIONS

This application is a national stage filing under 35 U.S.C. 371 of PCT/IB2020/057204, filed 30 Jul. 2020, which claims the benefit of U.S. Provisional Application No. 62/881,425, filed 1 Aug. 2019, the disclosures of which are incorporated by reference in their entireties herein.

BACKGROUND

Tapes are most often manufactured to be wound around a circular core. This is a common configuration that most users are accustomed to.

DETAILED DESCRIPTION

Figure 1:
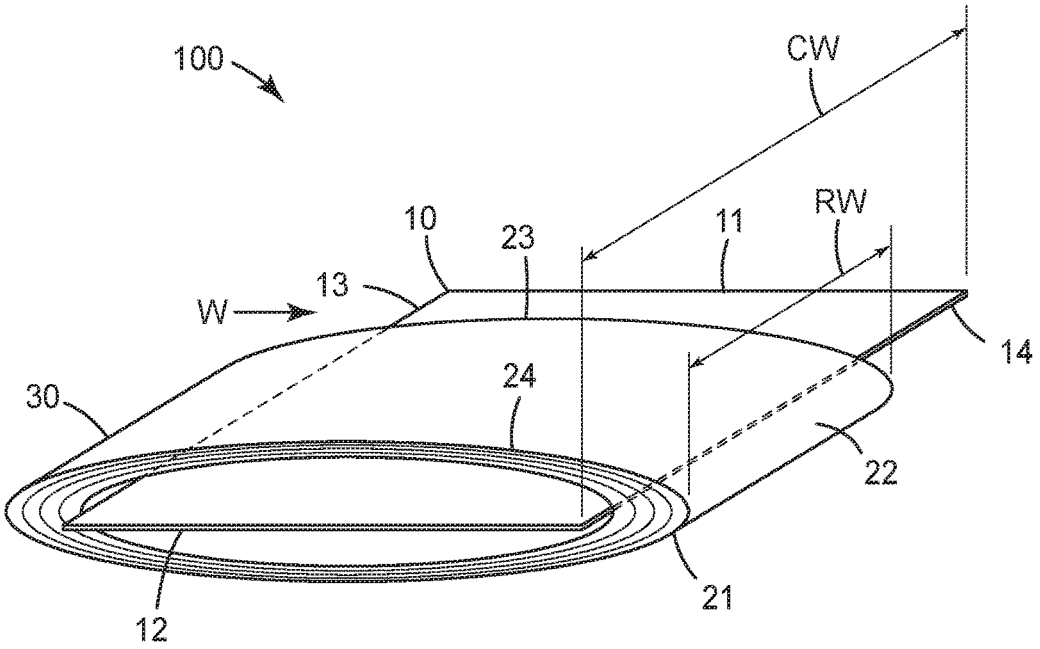
FIG. 1 is a tape article with a tape wound around an exemplary flat core.

Throughout this disclosure, singular forms such as "a," "an," and "the" are often used for convenience; however, the singular forms are meant to include the plural unless the singular alone is explicitly specified or is clearly indicated by the context. When the singular alone is called for, the term "one and only one" is typically used.

Some terms in this disclosure are defined below. Other terms will be familiar to the person of skill in the art and should be afforded the meaning that a person of ordinary skill in the art would have ascribed to them.

The terms "common," "typical," and "usual," as well as "commonly," "typically," and "usually" are used herein to refer to features that are often employed in the invention and, unless specifically used with reference to the prior art, are not intended to mean that the features are present in the prior art, much less that those features are common, usual, or typical in the prior art.

The inventors of this Application recognized several problems with tape articles. Tape articles can be inconvenient to keep in a pocket or handbag. One problem is that tape articles can be awkwardly shaped for keeping in a pocket, toolbox, work bag, handbag, etc. For example, tape that is wound in a circle, as most tape articles are, is not in a convenient shape to keep in a pocket, toolbox, bag, etc. In addition, regardless of the core shape, the edge of adhesive tape rolls can expose the adhesive on the tape edge to the surrounding environment. While this may not be problematic when the tape article is stored in a box or kept in a dispenser, it is a problem when the tape article is kept outside of a dispenser such as in a toolbox, in a pocket, or on a shelf. This is also a problem when the tape article is in use, for example, when the tape article is used outdoors or in a work area where dirt, dust, lint, etc. are present. In such cases, dirt, lint, and the like can adhere to the edges of the tape article, thereby making the tape article less attractive to the user and inhibiting the functionality of the tape.

While it may be possible to make a tape article by rolling a tape around a deformable round core and then deforming the article by flattening it the resulting article is not aesthetically pleasing and may have defects in the tape, so that approach is deemed unacceptable for the purposes of this disclosure. Also, when a flat tape article is made by this method, the tape article can be easily damaged by physical impact, such as by dropping on a hard surface like concrete, cement, asphalt, rock, or by inadvertently being struck with a tool such as a hammer. Thus, another problem is that the tape of tape articles can be easily damaged, particularly by physical impacts to the edge of the tape article, casing the tape lose some of its functionality or aesthetically attractive properties.

It should be noted that loss of aesthetically attractive properties is of technical import because users of tape articles are likely to associate loss of aesthetic attractiveness with a loss of functionality of the tape even if the tape in fact retains its functionality.

Briefly, a solution to one or more of these problems, as well as other problems, lies in a tape article comprising a flat or substantially flat core comprising a first major surface and opposing second major surface, as well as a first core edge and opposing second core edge and a third core edge and opposing fourth core edge. The core has a core width defined by the shortest distance from the first core edge to the second core edge.

A tape roll is around the flat core. The tape roll comprises a tape in a wound disposition in successive layers of tape around the flat core from the third edge to the fourth edge. With the exception of the first layer of tape in the tape roll, which is disposed directly against the flat core, each layer of tape in the tape roll is typically disposed directly above the layer below it, with a small allowance for manufacturing variances, such that the width of the tape roll is identical to the width of the tape itself.

Thus, the disclosure provides a tape article with a flat core having tape wound around the flat core. The resulting article tends to be slim or near flat, and thus takes up less space than a traditional circular tape article and thus is more convenient to store in a pocket, toolbox, shelf, etc. The flat core is configured so that part of the flat core projects beyond the edges of the tape. This configuration of the flat core protects the tape edges from dust, dirt, lint, etc. While any type of tape can be used in the tape article, the most common tapes are hand-tearable tapes. Examples include masking tapes, such as those with a backing material that is made of paper, which can optionally be coated, laminated, or saturated with a polymer, duct tape, which may have a backing layer made of yarn, fiber, or narrow plastic strip(s) laminated with a polymer, or hand-tearable transparent tape having a backing material that is bi-axially oriented polypropylene laminated with mono-axially oriented polypropylene. It is possible to use other types of tapes, such as those with a perforated backing.

The tape itself has a first side facing the flat core and an opposing second side. A first adhesive coating is typically present on the first side. The tape also has as a first tape edge and opposing second tape edge, wherein the shortest distance from the first tape edge to the second tape edge defines the tape width.

A tape roll has a tape roll width defined by the shortest distance between the first tape edge and the second tape edge. The core width is greater than the tape roll width, such that the first core edge extends beyond the first tape edge and the second core edge extends beyond the second tape edge. By this disposition, the first and second core edges act as a spacer to physically distance the first and second tape edges from dirt, lint, and the like, that might otherwise undesirably adhere to the first or second tape edges.

The flat core of the tape article is flat, as opposed to being circular, triangular, or some other shape. Typically, the flat core is manufactured of plastic, metal, paper, or the like. In principle any material can be used so long as it is sufficiently rigid so as not to appreciably bow during the winding process or under normal use. Rigidity can be assessed by the JIS K7171 test. Briefly, JIS K7171 is a three-point bending test that provides a strain stress curve. Most of the strain stress curve is linear, but the curve deviates from linearity and becomes parallel to the strain axis when the substrate being tested, here the flat core is about to break and eventually does break. The bend strength can be determined from this curve, as can the slope of the linear portion of the curve which can be likened to a modulus and has the units of $N/mm^2$. Typical flat cores that are suitable for use in the article and methods described herein have a bend strength of no less than 0.4 N/mm and a strain stress curve comprising a linear portion with a slope of 0.04 $N/mm^2$ or greater. In some particular cases, the bend strength can be 0.04 $N/mm^2$ or greater, 0.45 $N/mm^2$. or greater or even 0.5 $N/mm^2$. or greater. In particular cases, the bend strength can be 40 $N/mm^2$ or less, 35 $N/mm^2$ or less, 30 $N/mm^2$ or less, or even 25 $N/mm^2$ or less.

In some particular cases, the linear portion of the stress strain curve can be 0.04 or greater, 0.05 or greater, 0.06 or greater, 0.07 or greater, 0.08 or greater, or even 0.09 $N/mm^2$ or greater. In particular cases, the linear portion of the stress strain curve can be 40 $N/mm^2$ or less, 35 $N/mm^2$ or less, 30 $N/mm^2$ or less, or even 25 $N/mm^2$ or less.

In all cases, the values of the bend strength and linear portion of the stress strain curve are measured according to JIS K7171. In many cases, a flat core having lower values for either the bend strength or the slope of the linear portion of the stress strain curve will not be sufficiently rigid to stay flat during the manufacturing process or in use for example in the pocket of a user.

The flat core is in most cases substantially unbowed. The bow of the flat core is measured according to the method described in the Examples section. When measured according to the method described in the Examples section, the bow is typically no more than 5%, optionally no more than 4.2%, optionally no more than 4%, optionally no more than 3%, optionally no more than 2%, or optionally no more than 1%.

The flat core is in most cases not substantially twisted. Twist in this disclosure is measured according to the method disclosed in the Examples section. When measured according to the method disclosed in the Examples section, the flat core typically has a percent twist that is no more than 5%, optionally no more than 4.2%, optionally no more than 4%, optionally no more than 3%, optionally no more than 2%, or optionally no more than 1%.

The tape used in the article can in principle be any tape. Most often, the tape will have a backing material and an adhesive on the first side, wherein the first side is the side facing the flat core. However, it is also possible to use tapes that have a backing material and no adhesive.

Any backing material suitable for a tape can be used. Typical backing materials that can be used are made of paper, plastic, knits, fabrics, non-wovens, or composites of two or more of the foregoing. For example, fibers or yarns that are laminated with a polymer can be used as a backing material to increase the strength of the tape compared to fibers or yarns alone. One particular backing materials is bi-axially oriented polypropylene. Another particular backing material is polymer laminated paper. Another particular backing material is fiber yarns laminated with a polymer. Another particular backing material is mono-axially oriented polypropylene, and more particularly mono-axially oriented polypropylene laminated with bi-axially oriented polypropylene. The backing material can be transparent or translucent, and particularly transparent, to the human eye.

The backing material is often selected or configured to be tear-by-hand, meaning that a piece of tape can be torn from the tape article without the need for a cutting implement such as a knife. For example, when the backing material is mono-axially oriented polypropylene laminated with bi-axially oriented polypropylene the tape can be easily torn by hand in a substantially straight line. It is also possible to incorporate perforations into any backing material to impart tear by hand properties.

When used, the adhesive can in principle be any adhesive suitable for use on a tape. Exemplary adhesives include silicone adhesive, rubber adhesives, and acrylic adhesives. The adhesive may contain a tackifier, but this is not required in all cases because many adhesives are self-tacky. Pressure sensitive adhesives are most commonly employed.

When an acrylic adhesive is employed, it is typically a copolymer of two or more of (meth)acrylate esters. Optionally, the copolymer can include (meth)acrylic acid. Also optionally, the copolymer can include one or more other vinyl monomers (in addition to (meth)acrylic acid) such as styrene, n-vinyl pyrrolidone, vinyl acetate.

When a rubber-based adhesive is employed, it typically includes a rubber component, one or more tackifiers, and plasticizing oil. The rubber component may be natural rubber or synthetic rubber such as styrene/butadiene rubber, block copolymer of styrene and butadiene, or copolymer or block copolymer of styrene and isoprene. Typical tackifiers include wood rosin and its derivatives, terpene resins, and petroleum based resins.

Examples of tape without adhesive that can be employed include plumber's tape, tape made of polytetrafluoroethylene, bandages without adhesives (such as those sold under the trade designation ACE by 3M Company of St. Paul, MN, USA), athletic wraps, poly(tetrafluoroethylene) tape, and even gauze bandage. Examples of tape with adhesive that can be employed include those sold under the Scotch™ Brand by 3M Company, such as Scotch™ brand packaging tape, Scotch™ brand Magic Tape, masking tape, painter's tape, transparent tape, duct tape, carton sealing tape, box sealing tape, electrical tape, and the like.

In most cases the tape used in the context of this disclosure has a generally flat profile; string, thread, yarn, and similar items with a round profile are generally not considered tapes by the artisan and the tape in this disclosure typically does not have a round profile.

In some cases, the tape can have a second adhesive the second side, such as in so-called "two-sided tape." In such cases, there can be a liner on the second side covering the second adhesive.

In many cases when the first side is coated with adhesive and second side is not coated with adhesive, the second side is coated with a low adhesive backsize (sometimes known as an LAB). Any low adhesive backsize that is suitable for use with the adhesive can be employed. Most commonly, when a low adhesive backsize is used, it is a silicone-based low adhesive backsize. Silicone-based low adhesive backsizes are typically quiet when unwound, so employing silicone-based low adhesive backsizes can provide the advantage that the user can use the tape article in a variety of environments including those where making excessive noise could be problematic.

The tape article can be made by winding the tape around the core. A variety of methods suitable for winding tape around cores are known to the artisan. Typically, a pre-slit roll of tape is provided and attached to an unwinder. A flat core is then attached to a winder so that the core can be rotated. An end of the roll of tape is fixed to the flat core and then the flat core is rotated to unwind the tape from the pre-slit roll and wind the tape around the flat core.

It is possible to have indicia on the flat core. In particular, the indicia can be present on one or both portions of the flat core that extends beyond the tape edges. When present, the indicia may be printed, embossed, recessed, or debossed. One advantageous type of indicia that is particularly advantageous is a ruler, or measurement scale. The ruler can be used both to measure the distance of objects, for example objects to which the tape might be adhered, and also to measure the length of tape to be torn from the tape roll. Other types of indicia that may be present include indicia representing the type of tape on the article, information about the use of the tape, reminders regarding the properties of the tape, and the like.

Turning to the figures, FIG. 1 depicts article 100, which includes flat core 10 having first core edge 11, second core edge 12, third core edge 13, and fourth core edge 14. Tape 20 is wound around the flat core 10 in direction W from the third core edge 13 to fourth core edge 14. Tape 20 has first side 21 which faces the core 10 and opposing second side 22, as well as first tape edge 23 and opposing second tape edge 24. Tape roll has a roll width RW that is the shortest distance across the tape 20 from first tape edge 23 to second tape edge 24. The core width CW is the shortest distance across core 10 from first core edge 11 to second core edge 12. Core width CW is larger than roll width RW, and tape roll 30 is disposed on the core 10 such that first core edge 11 extends beyond first tape edge 23 and second core edge 12 extends beyond second tape edge 24.

Figure 2:
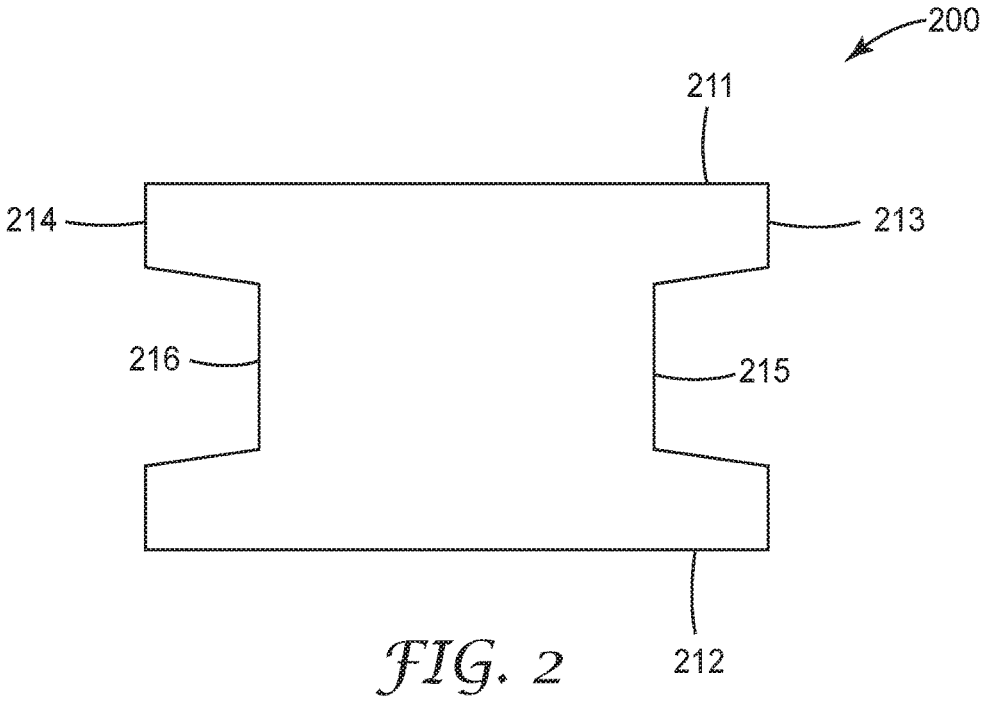
FIG. 2 is an exemplary flat core that is different from the flat core depicted in FIG. 1.

FIG. 2 depicts flat core 200 having first core edge 211 second core edge 212, third core edge 213, and fourth core edge 214. Third core edge 213 has notch 215 and fourth core edge 214 has notch 216. It should be noted that while notches 215, 216 provide some extra protection to tape 20, they are not required in all cases because a flat-wound tape article according to the invention can be achieved even without the notches because most of the edge of the tape that might adhere to dirt, dust, and the like is protected by the core even without the notches. Also, adding the notches may increase the cost of the tape article, so when cost is very important it may be desirable to omit them. Embodiments that include the notches, however, are advantageous for most applications.

While the flat core 10 can be any suitable dimension, typical dimensions are about 45-300 mm long and 12-210 mm wide. The notches typically have a depth of 0.1 to 50 mm and a width, depending on the width of the overall core, of 10-298 mm. In one particular case, the flat core is 120 mm long and 60 mm wide, with two notches each having a width of 51 mm and a depth of 2.5 mm.

Figure 3:
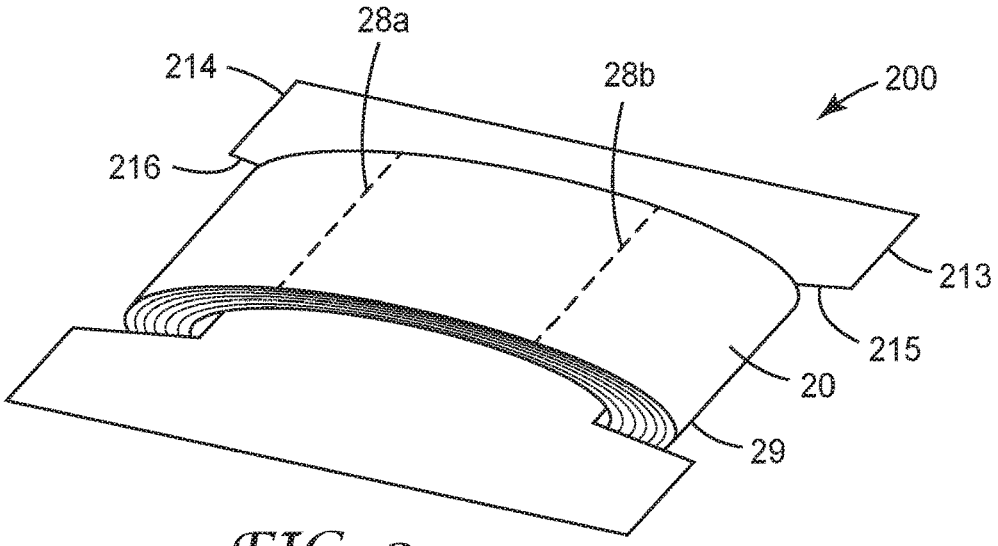
FIG. 3 is a tape article with a tape wound around the flat core that is depicted in FIG. 2.

FIG. 3 depicts tape 20 wound around flat core 200. Tape 20 is wound within notches 215, 216 in third and fourth core edges 213, 214 such that the notches 215, 216 are deeper than the distance between the outermost layer 29 of tape 20 and the core 200. This allows portions of third and fourth core edges 213, 214 to extend beyond the outermost layer 29 of tape 20. In this figure tape 20 has perforations 28*a*, 28*b* which can facilitate tearing a desired length of tape 20 from the article. Perforations are not required, and in the case where tapes that can be torn by hand without perforations are used then they are neither necessary nor desirable.

While in principle any length of tape 20 can be wound around flat core 200, typically the tape is long enough so that the thickness of the wound tape is 1.5 mm to 100 mm, such as 2 mm to 60 mm. The precise length will depend on the intended end use of the tape article, the type and thickness of the tape, and the dimensions of the flat core.

Figure 4:
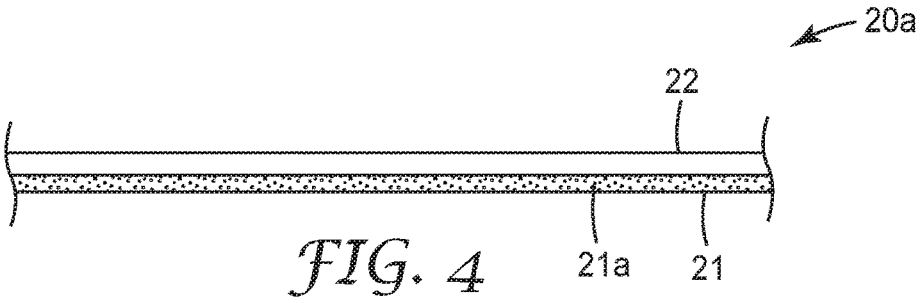
FIG. 4 is a side view of an exemplary section of tape.

FIG. 4 depicts a section of tape 20*a* having first side 21, second side 22, and adhesive 21*a* coated on the first side 21.

Figure 5:
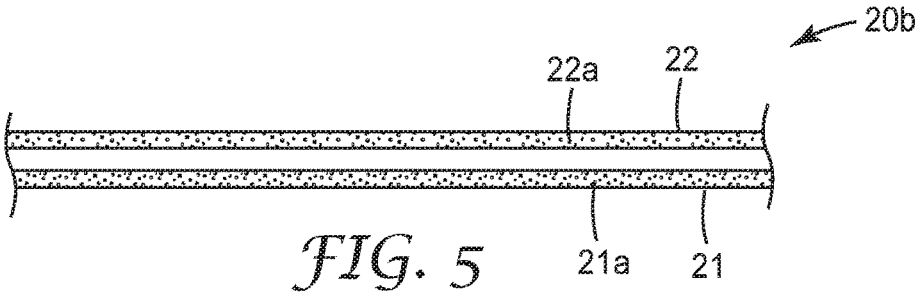
FIG. 5 is a side view of another exemplary section of tape.

FIG. 5 depicts a section of tape 20*b* having first side 21, second side 22, and adhesive 21*a* coated on the first side 21 and a low adhesion backsize 22*a* on second side 22.

Figure 6:
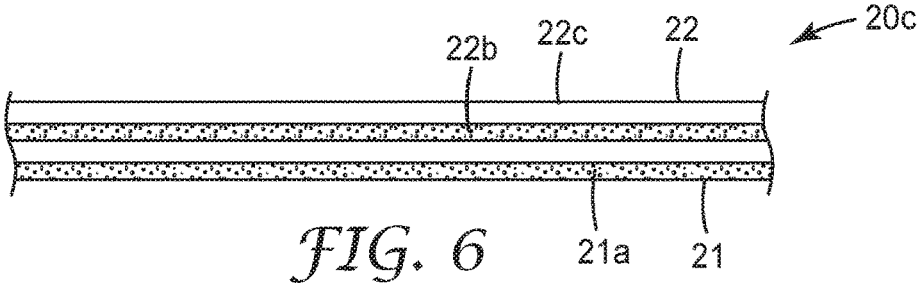
FIG. 6 is a side view of yet another exemplary section of tape.

FIG. 6 depicts a section of tape 20*c* having first side 21, second side 22, and adhesive 21*a* coated on the first side 21 and a second adhesive 22*b* is coated on second side 22. Liner 22*c* covers second adhesive 22*b* in this figure, but second adhesive 22*b* can be present without liner 22*c* in some cases.

FIG. 7 depicts tape article 1700 featuring tape 70 wound around flat core 700. Points 71*a*, 71*b*, 71*c*, and 71*d* are the locations where an edge of tape 70 intersects with flat core 700. Imaginary line L1 connects points 71*a* and 71*d*, and imaginary line L2 connects points 71*b* and 71*c*. Imaginary lines L1 and L2 intersect at point 72 on the surface of tape article 1700.

EXAMPLES

Rigidity Tests

All rigidity testing was performed according to the JIS K7171 test method, a 3-point bending test with 25 mm width, 100 mm length and 80 mm distance between the fulcrums. All bend strength and slope of strain stress curves in this disclosure were determined, or are to be determined, using this method.

Determining Bow and Twist

Figure 7A:
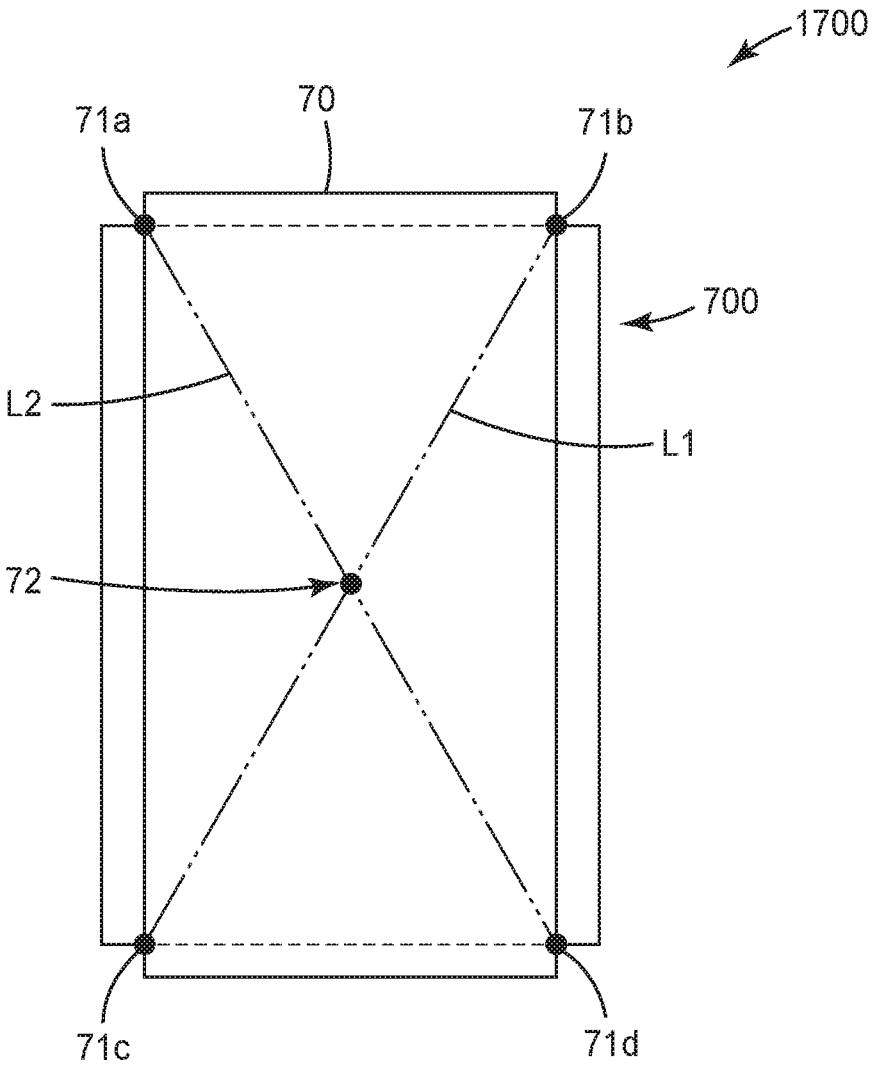
FIGS. 7A-7E are schematics of a tape article featuring a tape wound around an exemplary flat core for illustrating how bow and twist are determined in this disclosure.

All bow and twist percentages referred to in this disclosure were determined, or are to be determined according to the method described below. FIGS. 7A-7E help illustrate how bow and twist are determined. Generally, FIG. 7A depicts tape article 1700 featuring tape 70 wound around flat core 700. Points 71*a*, 71*b*, 71*c*, and 71*d* are the locations where an edge of tape 70 intersects with flat core 700. Imaginary line L1 connects points 71*a* and 71*d*, and imaginary line L2 connects points 71*b* and 71*c*. Imaginary lines L1 and L2 intersect at point 72 on the surface of tape article 1700.

Figure 7B:
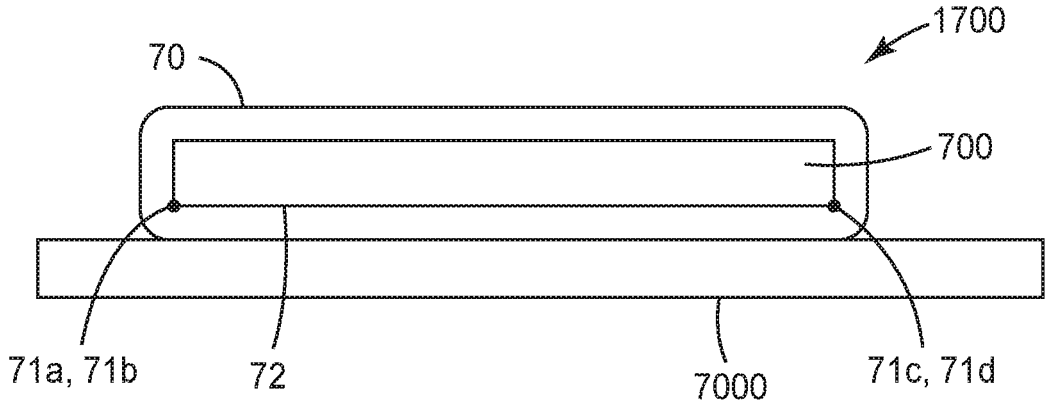

Bow and twist are determined by placing the tape article against flat plate 7000. FIG. 7B depicts the case where all of points 71*a*, 71*b*, 71*c*, 71*d*, 72 contact flat plate 7000 and the entire tape 70 contacts flat core 700. In this instance, the bow is defined to be zero and the twist is defined to be zero.

Figure 7C:
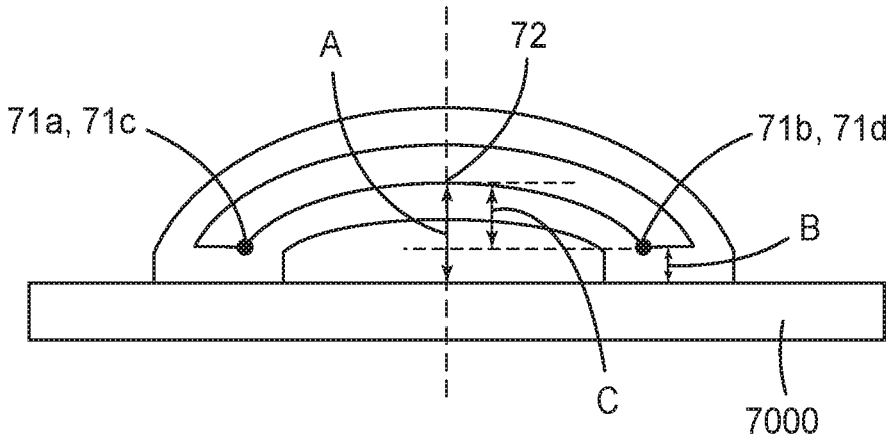
Figure 7D:
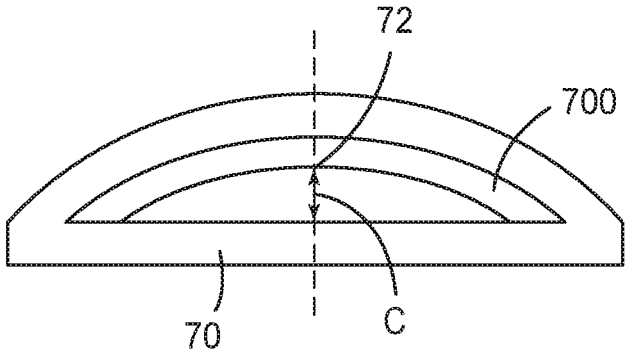

FIGS. 7C and 7D depict the two situations where the bow is non-zero. In FIG. 7C, tape roll 70 does not contact flat plate 7000 at point 72, but tape roll 70 maintains contact with flat core 700. In this situation, a vertical distance A is measured between point 72 on flat core 700 and flat plate 7000. The vertical distances between each of points 71*a*,

71*b*, 71*c*, 71*d* and flat plate 7000 are also measured, and the shortest of those vertical distances is distance B. A clearance C, which corresponds to the vertical distance between the inner portion of the tape roll 70 and the nearest of points 71*a*, 71*b*, 71*c*, 71*d* on the flat core is calculated by subtracting B from A.

In the event that tape roll 70 does not maintain contact with flat core 700, as depicted in FIG. 7D, the clearance C is calculated directly as the vertical distance between the inner portion of tape roll 70 and point 72 on flat core 700.

After the clearance is determined the article is then flattened against the flat plate by applying hand pressure until all of points 71*a*, 71*b*, 71*c*, 71*d*, 72 contact the plate. The longitudinal length, defined as the distance between 71*a* and 71*c* or between 71*b* and 71*d*, is measured in this state.

The percent bow is calculated as the ratio of the clearance C to the longitudinal distance, expressed as a percent.

Figure 7E:
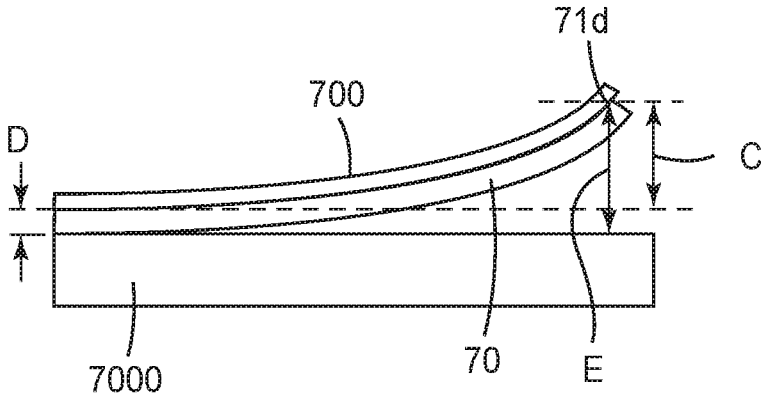

FIG. 7E depicts a case where the twist is non-zero, that is, where one of points 71*a*, 71*b*, 71*c*, 71*d* (in this FIG. 71*d*) does not touch flat plate 7000 when the other points 71*a*, 71*b*, 71*c* are in contact with flat plate 700. Distance D is measured as the vertical height of tape roll 70. Distance E is measured as the vertical distance between flat plate 7000 and point 71*d* on flat core 700. Clearance C is calculated as the E less D.

Longitudinal distance is then measured as described above with respect to bow. The percent twist is calculated as the ratio of clearance C to the longitudinal distance, expressed as a percent.

It is possible for both the bow and twist to be non-zero, in which case both are determined separately following the procedures described above.

Example 1

A polystyrene core (120 mm long, 60 mm wide, 2 mm thick, purchased from Nippon Tact, Tokyo, Japan) was tested for rigidity. The bending strength was 1.2 N/mm and the slope of the stress strain curve was 0.15 N/mm$^2$. Scotch® Brand adhesive packaging tape (48 mm width) was wound around the length of the core. The core projected beyond the tape roll by 6 mm on both sides. After winding, no bow or twist was measurable in the core (that is, the bow and twist were both 0%).

Example 2

A paper core (three layers: two 0.45 mm skin layers of cardboard paper and 1.0 mm intermediate layer of cardboard paper purchased from Suzuki Shiko, Kanagawa Japan; total dimensions 120 mm long, 60 mm wide, 2 mm thick) was tested for rigidity. The bend strength was 0.56 N/mm and the slope of the stress strain was 0.095 N/mm$^2$. Scotch® Brand adhesive packaging tape (48 mm width) was wound around the length of the core. The core projected beyond the tape roll by 6 mm on both sides. After winding, no bow or twist was measurable in the core (that is, the bow and twist were both 0%).

Example 3

Notches (51 mm wide and 2.5 mm deep) were cut in the 60 mm edges of a paper core described in Example 2. Scotch® Brand adhesive packaging tape (48 mm width) was wound around the length of the core so that the tape was disposed in the notches. The core projected beyond the tape roll by 6 mm on both sides, and by approximately 1 mm in the length. After winding, no bow or twist was measurable in the core (that is, the bow and twist were both 0%).

Comparative Example 1

A polystyrene core that is identical to that of Example 1 except that it had a thickness of 1 mm was tested for rigidity. The bend strength was 0.29 N/mm$^2$ and the slope of the SS curve was 0.022 N/mm$^2$.

A Scotch® brand packaging tape (48 mm width) (3M Company, St. Paul MN USA) was wound around the core. Approximately 5 minutes after winding, the article to be noticeably bowed with a 7.9% (9.5 mm) bend in the core and corresponding bend in the tape that was wound around the core.

Comparative Example 2

A corrugated paper core (120 mm length, 60 mm width, 2.5 mm thick) was provided. Scotch® Brand adhesive packaging tape (48 mm width) (3M Company, St. Paul MN USA) was wound around the length of the core. The core projected beyond the tape roll by 6 mm on both sides. After winding, the visual inspection by a human detected no perceivable bow or twist in the core. The core was then cut down its length next to the tape on one side so that the core did not project beyond the edge of the tape on that side; the side without the core projection is referred to as the "unprotected side."

Example 4

An edge protection experiment was conducted on the article of Example 1 as follows. Tape samples were placed on a surface in a holder, edge side up. A brass brush weighting 100 g was hung 50 cm above the surface. The brush was allowed to fall on the tape edge. This was repeated 10 times for each sample. The tensile strength of the tape and elongation of the tape roll were measured.

Comparative Example 3

The text described in Example 4 was performed on the unprotected side of the article of Comparative Example 2.

Reference Example 1

The tensile strength and elongation of Scotch™ brand Tear by Hand Low Noise tape (available from 3M Company, MN, USA) was determined.

The results of Example 4 ("EX. 4"), Comparative Example 3 ("CEX. 3"), and Reference Example 1 ("REX. 1") are reported in Table 1. In Table 1, "avg" stands for "average" and means the arithmetic mean, and "StD" stands for "Standard Deviation." Tensile strengths are reported in units of N/10 mm and elongation is reported as a percent.

TABLE 1

| | | Experimental Results | | |
|---|---|---|---|---|
| | | EX. 4 | CEX. 3 | REX. 1 |
| Tensile Strength | avg | 34.5 | 33.55 | 36.77 |
| | StD | 0.96 | 1.62 | 1.71 |
| Elongation | avg | 66.42 | 29.15 | 66.92 |
| | StD | 11.71 | 16.4 | 9.53 |

What is claimed is:

1. A tape article comprising a flat core having a bend strength of no less than 0.4 N/mm and a strain stress curve comprising a liner portion with a slope of 0.04 $N/mm^2$ or greater when tested according to JIS K7171, the core comprising a first major surface and an opposing second major surface, a first core edge and an opposing second core edge, the second core edge being essentially parallel to the first core edge, a core width defined by the shortest distance from the first edge to the second edge, and a third core edge and an opposing fourth core edge; and a tape roll comprising a tape, the tape comprising a backing material having first side and opposing second side, and a first tape edge and opposing second tape edge, and a tape roll width defined by the shortest distance between the first tape edge and the second tape edge; wherein the tape is in a wound disposition in successive layers of tape around the core from the third core edge to the fourth core edge, the core width is greater than the tape roll width, the first core edge extends beyond the first tape edge, and the second core edge extends beyond the second tape edge.

2. The article of claim 1, wherein the tape roll comprises the tape roll having a roll height defined by the longest distance between one of the first major surface, second major surface, third core edge, or fourth core edge and the exterior portion of tape; and at least one of the third core edge and the fourth core edge comprising a notch; wherein the tape roll is disposed within the notch, and the notch depth is no less than the roll height.

3. The article of claim 1, wherein the tape roll is substantially free of visible air pockets.

4. The article of claim 1, further comprising a first adhesive coating on the first side of the backing material, wherein the first adhesive is a pressure sensitive adhesive.

5. The article of claim 4, further comprising a liner on the first adhesive coating.

6. The article of claim 1, further comprising a second adhesive coating on the second side of the backing material.

7. The article of claim 1, further comprising a low adhesive backsize on the second side of the backing material.

8. The article of claim 1, wherein at least one of the first adhesive and the second adhesive is a pressure sensitive adhesive.

9. The article of claim 1, wherein the backing material comprises paper.

10. The article of claim 1, wherein the backing material comprises yarn or fiber.

11. The article of claim 1, wherein the backing material comprises bi-axially oriented polypropylene.

12. The article of claim 1, wherein the backing material is laminated with mono-axially oriented polypropylene.

13. The article of claim 1, wherein the backing material is transparent or translucent to the human eye.

14. The article of claim 1, wherein the tape is transparent tape, duct tape, masking tape, painter's tape, packaging tape, carton sealing tape, or electrical tape.

15. The article of claim 1, wherein the flat core has a bend strength of 40 $N/mm^2$ or less when tested according to JIS K7171.

16. The article of claim 1, wherein the flat core has a slope of the linear portion of the stress strain curve is 40 $N/mm^2$ or less.

17. The article of claim 1, wherein the article has a bow of 5% or less.

18. The article of claim 1, wherein the article has a twist of 5% or less.

19. A method of using an article of claim 1, the method comprising unwinding at least a portion of the tape from the flat core and tearing or cutting the at least a portion tape.

20. The method of claim 19, further comprising adhering the cut or torn at portion of tape to an article.

* * * * *